United States Patent [19]

Ono

[11] 4,094,094

[45] June 13, 1978

[54] SOUND MAKING MOVABLE TOY

[75] Inventor: Tasuku Ono, Tokyo, Japan

[73] Assignee: Stiron Chemical Industry Co. Ltd., Tokyo, Japan

[21] Appl. No.: 762,411

[22] Filed: Jan. 25, 1977

[30] Foreign Application Priority Data

Oct. 4, 1976 Japan ..... 51-133988[U]

[51] Int. Cl.[2] ..... A63H 5/00

[52] U.S. Cl. ..... 46/232

[58] Field of Search ..... 46/178, 232

[56] References Cited

U.S. PATENT DOCUMENTS 3,517,456 6/1970 Reder et al. ..... 46/232

3,839,822 10/1974 Rexford ..... 46/232

*Primary Examiner*—Louis G. Mancene

*Assistant Examiner*—Robert F. Cutting

*Attorney, Agent, or Firm*—Otto John Munz

[57] ABSTRACT

A sound making movable toy which is provided with a sound making device and driving wheels driven by a driving power source, the sound making device comprising: a blowing chamber having a fan and a sounding aperture; a main resonance chamber communicating with the sounding aperture; a resonance control chamber communicating with the main resonance chamber; a piston reciprocating within the resonance control chamber; and a crank mechanism to move the piston; thereby the sounds of various pitches being produced by changing the resonant volume of a resonance space defined by the main resonance chamber and the resonance control chamber with the reciprocating motion of the piston.

3 Claims, 11 Drawing Figures

SOUND MAKING MOVABLE TOY

CROSS-REFERENCE TO RELATED APPLICATIONS

As a fundamental invention relative to the present application, there is a U.S. Pat. No. 3,747,266, entitled "Sounding Device", patented on July 24, 1973, invented by the same inventor, filed on Sept. 12, 1972 with an application Ser. No. 288,405, and assigned to Suchiron Kagaku Kogyo Kabushiki Kaisha and Daishin Trading Co., Ltd. in Japan. As an improvement of the above made by the same inventor, Tasuku Ono, was granted a U.S. Pat. No. 3,908,505, entitled "Melody Blowing Device", patented on Sept. 30, 1975, filed on Aug. 6, 1974 with an application Ser. No. 495,137, and assigned to Stiron Chemical Industry Co., Ltd., Tokyo, Japan. The present invention is a further improvement relative to the above inventions.

FIELD OF THE INVENTION

This invention relates to a sound making movable toy. More particularly, the invention relates to an improved sound making movable toy which makes automatically and continuously clear, vivid and delighting sounds attracting children's attention. Further, the sound given out from the toy is somewhat of the alarm whistle of a police car used in the United States.

Since the sounding mechanism used for this toy can be made small in size and simple in structure, it can be easily build in a toy or the like, and children may play with great interest being attracted by the special tone quality of the toy.

DESCRIPTION OF THE PRIOR ART

One of hitherto known sound making devices which produce simple melodies of the same or different sounds, is provided with a casing forming a main resonance chamber with a sounding aperture, a blowing chamber in another separate casing having therein a fan for continuously supplying air to the sounding aperture, and a plurality of auxiliary resonance chambers that communicate with the main resonance chamber through respective openings. The above openings to the main chamber are separately opened and closed so as to selectively vary the resonant volumes and to make various sounds. With this device, however, only a simple melody is played and sounds of several pitches are continuously made but the variety of tempo in the progression of sounds is poor. So that, the toyes of this kind is soon gotten tired of. It is therefore difficult with such a conventional sound making device to make veriously pitched sounds similar to the alarm whistles of police cars in the United States since the sound making mechanism has to be made larger and more complicated. Further, in oder to make such sounds, there is known an electronic sound making method in which a pole plate is vibrated by electromagnetic force. However, the mechanism of such device is highly graded, complex and large-sized, therefore, it is difficult and expensive to build it in a small-sized toys.

SUMMARY OF THE INVENTION

The first object of the present invention is to provide a sound making movable toy having a simplified sound making device which produces clear, refreshing and excitingly vivid sounds with large variations in sound progression, which sounds resemble the alarm whistle of police cars in the United States and are varied quickly in high-pitched ranges and slowly in low-pitched ranges of the sounds.

The second object of the invention is to provide a sound making movable toy having a built-in sound making device which equals to electronic sounding devices of high-graded and expensive mechanism, and is simple in structure and small in size so as to be easily produced and mounted in a toy.

In accordance with the present invention, the sound making device to be built in a toy comprises: a blowing chamber being provided with a sounding aperture and a fan driven by a driving source; a main resonance chamber adjoining the above blowing chamber and communicating with the sounding aperture; a tubular resonance control chamber one side end of which communicates with the main resonance chamber and the other side end of which is opened; a piston reciprocating within the resonance control chamber with sealed engagement; and a crank mechanism consisting of a movable crank rod and a rotating crank piece. One end of the above rotating crank piece is connected to an end of a rotary shaft which is rotated by the above driving source through a series of gears and the other end of the rotating crank piece is pivoted to one end of the movable crank rod. Thus driven movable crank rod is pivoted at its other end to the center of the outer surface of the piston. With the above structure, various sounds are made by changing the resonant volume of the main resonance chamber plus the tubular resonance control chamber by means of the reciprocation of the above piston.

BRIEF DESCRIPTION OF THE DRAWINGS

These and other objects and features of the invention will become more apparent from the following description taken in connection with the accompanying drawings, in which.

DESCRIPTION OF THE PREFERRED EMBODIMENT

Figure 1:
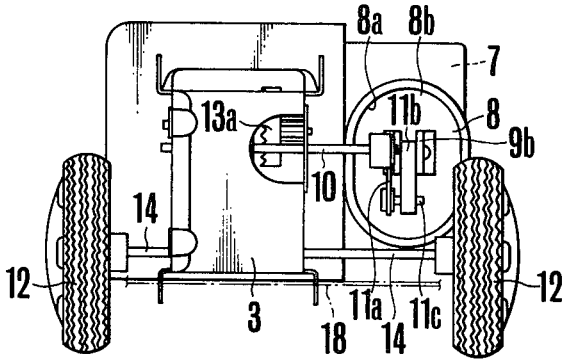
FIG. 1 is a front view of an embodiment of the present invention, in which the body is taken off.

Referring now to the accompanying drawings, the embodiment of the present invention will be described in detail.

The whole body of the sound making movable toy A is provided with a sound making device 1 which comprises a blowing chamber 2, a main resonance chamber 7, a resonance control chamber 8, a piston 9 reciprocating in the control chamber 8, a rotary shaft 10 and a crank 11, the last two driving the above piston 9.

Figure 2:
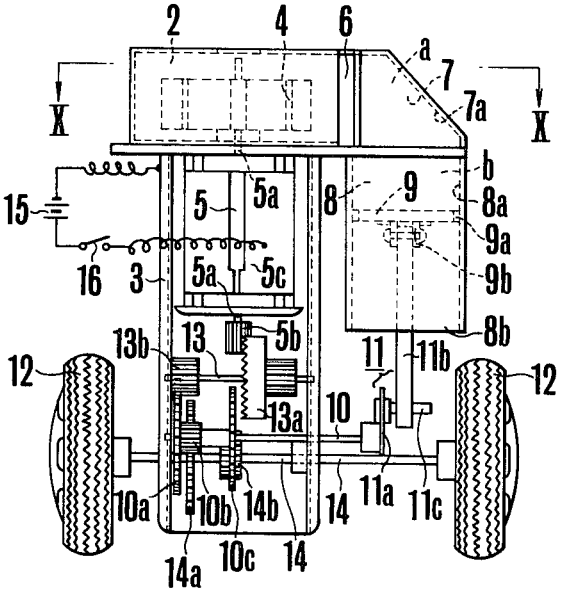
FIG. 2 is a plan view of the same embodiment.
Figure 10:
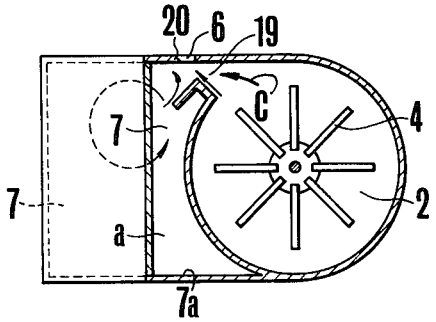
FIG. 10 is a rear view of the main portion of the sound making device showing the relation among the blowing chamber, the main resonance chamber and the resonance control chamber.

The blowing chamber 2 is formed at the rear side of a machine frame 3 as shown in FIG. 2 (the upper side is the rear of the toy and the lower side, the front, in FIG. 2). In the blowing chamber 2, a fan 4 is attached which is driven by a motor 5 fitted in the rear portion of the machine frame 3. In the wall portion of the blowing chamber 2 is formed a sounding aperture 6. The air stream C caused by the fan 4 is passed through a narrow passage 19 (FIG. 10) and led against a baffle piece 20. The air stream C is thus divided and one portion of the divided stream is exhausted from the sounding aperture 6 and the other portion of the divided stream is introduced into the main resonance chamber 7. In this action, whirls of air are caused to occur so that sound are produced according to the resonant volume of the resonance space B which will be further explained in the later part.

Figure 3:
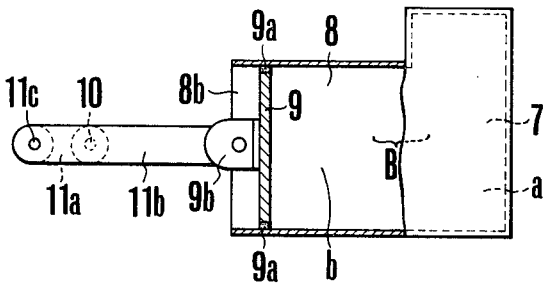
FIG. 3 is a right elevation partially in cross-section of the main part of a sound making device, in which the resonant volume is made maximum.
Figure 4:
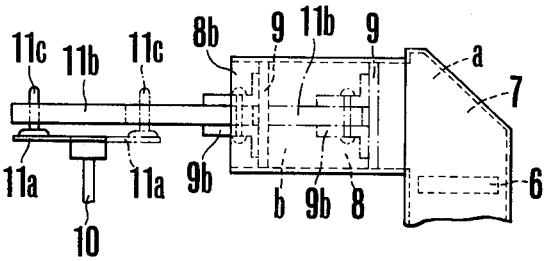
FIG. 4 is a bottom view of the main part of the sound making device, in which the maximum and minimum resonant volumes are indicated.

A main resonance chamber 7 is adjoined to the blowing chamber 2. This resonance chamber 7 has an inner cavity **7*a* which communicates with the above-mentioned sounding aperture 6. To this main resonance chamber 7 is connected a resonance control chamber 8 in the form of a cross-sectionally oval cylinder, which control chamber 8 has an inner cavity 8*a* communicating with the innver cavity 7*a* of the main resonance chamber 7, and an opening 8*b* on the opposite side thereof. A piston 9 is slidably fitted in the resonance control chamber 8 and a sealing member 9*a* is attached on the peripheral surface of the piston 9 so as to seal up the inside of the resonance control chamber 8. A crank mechanism 11 is formed in the space between the center of the outer surface of the piston 9 and a rotary shaft 10 that is driven by a motor 5. In the crank mechanism 11, a rotating crank piece 11*a* directly attached to the rotary shaft 10 and a movable crank rod 11*b* to reciprocate the piston 9 are joined by a connecting rod 11*c*. The center of the piston 9 and the movable crank rod 11*b* are connected by a fulcrum pin 9*b* as shown in FIGS. 3 and 4**.

In the driving mechanism to move the crank mechanism 11 and wheels 12, the pinion **5*b* attached to a motor shaft 5*a* engages with a gear 13*a* fixed to a shaft 13 that is carried by the machine frame 3. Further, another pinion 13*b* on the same shaft 13 is engaged with a gear 10*a* on the shaft 10 that is carried by the machine frame 3, thereby driving the shaft 10 by the rotation of the motor 5. At the same time, the pinion 10*b* fixed on the shaft 10 engages with a gear 14*a* that is attached to the driving shaft 14 for wheels 12 so as to rotate the driving shaft 14, while a gear 10*c* fixed to the rotary shaft 10 further drives the driving shaft 14 with the engagement between the gear 10*c* and a gear 14*b* that is attached to the driving shaft 14**.

Further, the other end of the shaft **5*a* of the motor 5 is connected to the shaft of the fan 4 to rotate it simultaneously. One terminal (+) of the excitation coil of motor 5 is connected to the casing 5*c* and the other terminal (−) is connected to the machine frame 3. The casing 5*c* and the machine frame 3 are electrically insulated and a power source 15 and a switch 16 are connected in series between the casing 5*c* and the machine frame 3**.

With the above-described structure, the rotating crank piece **11*a* is caused to rotate on the shaft 10 so that the movable crank rod 11*b* connected to the crank piece 11*a* by the connecting rod 11*c* is moved back and forth by the rotation of the crank piece 11*a*. Therefore, the piston 9 reciprocates in the resonance control chamber 8** by the above motion.

Figure 5:
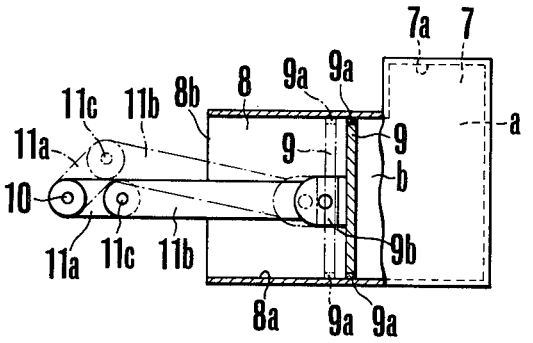
FIG. 5 is a right elevation partially in cross-section of the main part of the sound making device, in which the resonant volume is made minimum.
Figure 6:
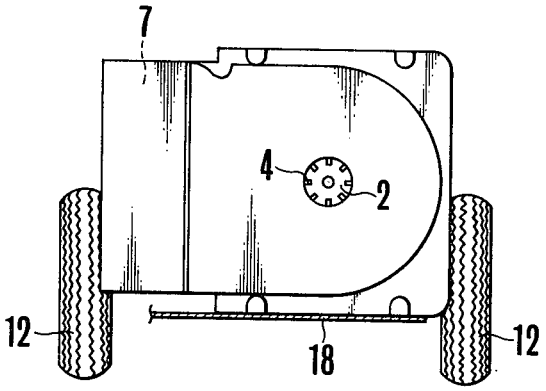
FIG. 6 is a rear view of the embodiment, in which the chassis is cut away and the body is taken off so as to show the sound making device and front wheels.
Figures 9A, 9B:
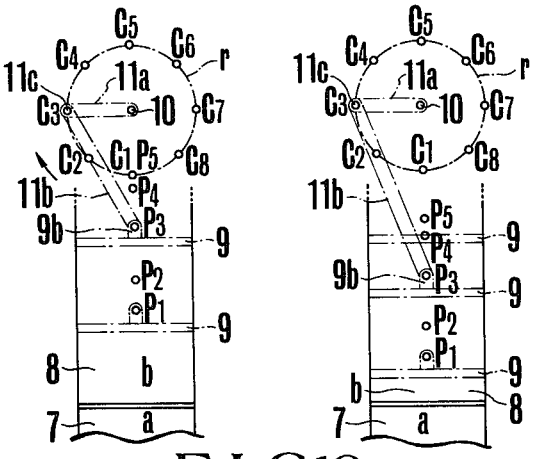
FIGS. 9 (*a*) and 9 (*b*) are explanatory drawings showing the states of the making of high-pitched, medium-pitched and low-pitched sounds in the related motions of cranks and pistons, in which the ratios of rotating crank pieces and movable crank rods are made 1:2 and 1:3.

The resonance space B is the sum of the space of the main resonance chamber 7 and that of the resonance control chamber 8 which is closed by the piston 9. That is, the resonance space B is the sum of a resonant volume *a* of the main resonance chamber 7 and a resonant volume *b* of the resonance control chamber 8. The volume of the resonance space B is changed every second by the movement of the piston 9. As shown in FIGS. 3 and 4, when the connecting rod **11*c* reach the apex in the rotary motion round the rotary shaft 10, the movable crank rod 11*b* is moved away so that the piston 9 is pulled to the position near the opening 8*b* of the resonance control chamber 8. In this position, the volume of the resonance space B becomes maximum to make lowest sounds when air is exhausted through the sounding aperture 6. When the connecting rod 11*c* reach the lowest point (the right in FIG. 4) in the rotary motion thereof as shown in FIGS. 4 and 5, the piston 9 is moved back toward the main resonance chamber 7 so that the resonant volume $(a + b)$ becomes minimum. With the blowing through the sounding aperture 6, the highest tone is produced and the pitch of the sound may be within one octave range and agreeable to the ears. The variation of sounds between the high pitch and low pitch that are caused by the movement of the crank mechanism 11 will be described with reference to FIGS. 9** (*a*) and 9 (*b*). In FIG. 9 (*a*), the ratio of the rotating crank piece **11*a* to the movable crank rod 11*b* in lengths is set at 1:2, while in FIG. 9** (*b*), such ratio is set at 1:3. Provided that the positions of fulcrums of the connecting rod **11*c* between the rotating crank piece 11*a* and the movable crank rod 11*b* are $C_1$, $C_2$, $C_3$, . . . $C_8$ and the corresponding positions of the fulcrum pin 9*b* between the movable crank rod 11*b* and the piston 9 are $P_1$, $P_2$, $P_3$, $P_4$, $P_5$, $P_4$, $P_3$, $P_2$, $P_1$. The positions of crank members will be herein indicated as those of FIGS. 9** (*a*) and 9 (*b*). When the fulcrum rod **11*c* of the rotating crank piece 11*a* comes to the lowermost position $C_1$ in the circumferential locus $\gamma$ (both crank members 11*a* and 11*b* are brought into line), the piston 9 reach the lowest position $P_1$ so that the resonant volume $(a + b)$ of the resonance space becomes minimum. Accordingly, the sound of highest pitch is produced. When the position of the fulcrum rod 11*c* is changed from $C_1$ to $C_2$, $C_3$, $C_4$, $C_5$ and further $C_6$, $C_7$, $C_8$ and again to $C_1$ in clockwise rotation, the position of the fulcrum pin 9*b* correspondingly moves from the positions of $P_1$ to $P_2$, $P_3$, $P_4$, $P_5$, $P_4$, $P_3$, $P_2$ and $P_1$ in due order. In the case that the fulcrum rod 11*c* of the rotating crank piece 11*a* is moved in a circle at a certain speed, the piston 9 is moved quickly in the ranges of $C_1$ to $C_4$ and $C_6$ to $C_1$. In other words, the resonant volume $(a + b)$ of the resonance space is quickly increased or decreased. In the position of $C_5$ at the top of the circular locus $\gamma$, the above crank members 11***a* and 11*b* are put together one upon the other and the piston 9 is positioned at the uppermost point $P_5$. Accordingly, the resonant volume $(a + b)$ becomes maximum to make the sound of the lowest pitch. In the ranges of $C_4$ to $C_5$ and $C_5$ to $C_6$, the piston 9 is correspondingly moved from the position of $P_4$ to $P_5$ and $P_5$ to $P_4$, however, the variation of the volume of the resonance space B is very small during the above ranges. Therefore, the variation of the sound becomes very slow. That is, three fourths of the piston stroke are varied rapidly, while the remaining one fourth of the piston stroke is varied slowly. In other words, the high-pitched sound is quickly varied during the minimum resonant volume $(a + b)$ of the resonance space B, meanwhile, the low-pitched sound is slowly varied during the remaining maximum resonant volume so that only the high-pitched sound is heard noticeably and the produced sounds resemble the alarm whistles of police cars in the United States. The functions of the device shown in FIG. 9 (*b*) is similar to those of the foregoing one shown in FIG. 9 (*a*), however, the minimum resonant volume $(a + b)$ of the device in FIG. 9 (*b*) becomes smaller than that of the device in FIG. 9 (*a*), so that the high-pitched sound becomes a little higher within one octave.

The sound in the range of one octave is not preferable to be heard since the highest pitch tone is too high. In the case that the sound is covered within the range of about three fourths of one octave, i.e., in the range of "do, re, mi, fa, sol and la", the highest sound, la, may be agreeable and clear to be heard. However, if desired, the sound covering one octave range or wider can be made by making the maximum resonant volume of the resonance control chamber 8 double or more as compared with the main resonance chamber 7, while the ratio of rotating crank piece 11 to movable crank rod 11*b* being set at 1:2 to 1:3.

Further, the configuration of the resonance control chamber 8 may be of a cylinder, square pillar or any other desired shape. The resonance control chamber 8 shown in the drawings is of actual size and suitable to be built in a small-sized movable toy. The clarity and loudness of produced sound are also adequate.

Figure 7:
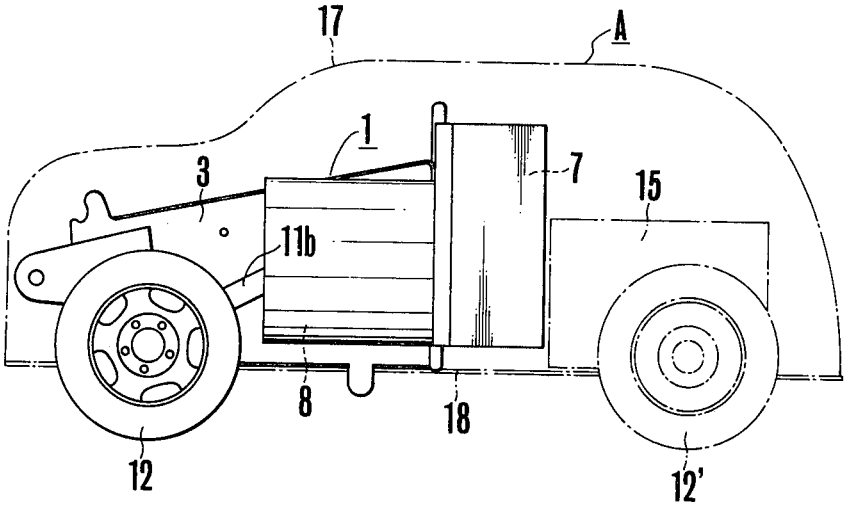
FIG. 7 is a right side view of the embodiment showing the sound making device and front wheels by taking off the rear part of chassis and the body.
Figure 8:
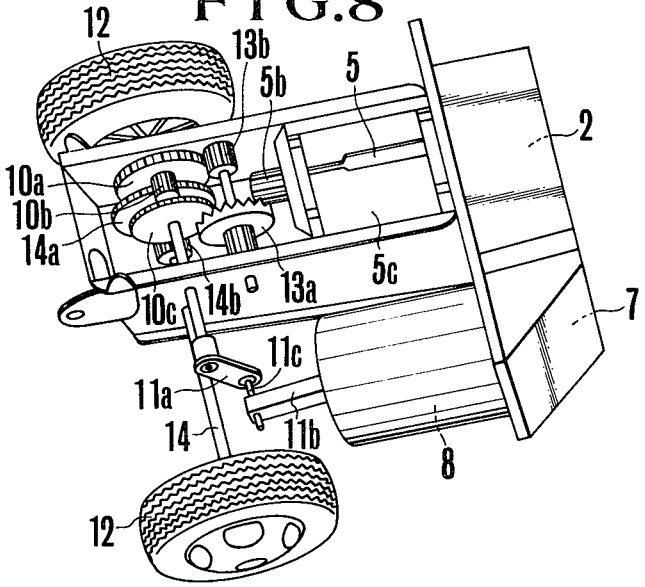
FIG. 8 is a perspective view of the main portions of front wheels, crank-driving mechanism, machine frame and sound making device.

As shown in FIG. 7, the sound making device is built in a police car, a fire engine or any desired movable toy, in which a body 17 is fitted to the chassis 18 having follower wheels 12'.

In addition to the above, the ratio between the ratating crank piece 11*a* and the movable crank rod 11*b* is not restricted to the above-described values and any suitable sealing means may be fitted to the sliding surface of the pistone.

According to the present invention, the main resonance chamber adjoins the blowing chamber having a sounding aperture and the former resonance chamber communicates with the sounding aperture. A cylindrical resonance control chamber is connected to the main resonance chamber and the control chamber is provided with an open end portion on one side. The maximum resonant volume of the resonance control chamber 8 is set double or more as large as the resonant volume of the main resonance chamber 7. To the control chamber 8 is fitted a piston 9 slidably and airtightly, which piston is connected to the rotary shaft 10 through the crank mechanism 11. The ratating crank piece 11*a* and the movable crank rod 11*b* of the crank mechanism 11 have the length ratio of 1:2 to 1:3. The piston is reciprocated within the above resonance control chamber by the rotating motion of the rotary shaft through the crank mechanism. The range of variation of the resonant volume of the resonance space B that is defined by the boundary of piston movement, is set so as to cover almost all sounds of one octave range. The high-pitched sound produced at the minimum resonant volume $(a + b)$ is varied quickly by the interlocked motions of the crank mechanism and the piston, while the low-pitched sound produced at the maximum resonant volume $(a + b)$ is veried very slowly. The sound in the intermediate range between the high and low pitched sounds is varied relatively quickly. Thus the sounds produced from the sound making movable toy of the present invention resemble the sharp and repeated whistle of the police cars in the United States of America. Accordingly, the sound making movable toy of the invention is novel, original and attractive not only for children but also for adults.

Furthermore, the volume of the resonance space B can be changed with variable speed by the movements of the piston and the crank mechanism so that the sounds in high-pitched range are veried quickly and those in low-pitched range can be varied slowly to bring about the variety of the produced sounds. The repeatedly produced sounds are thus attractive, refreshing and vivid to the extent that sleeping children are awoken taking interest, and as mentioned above, the sounds resemble the alarm whistles of the police cars practically used in the United States. Still further, the sound making device 1 of the present invention is small in size, simple in structure and easy in manufacturing so that it can be made compact at low cost to be built in a small-sized movable toy. Therefore, mass production system can be employed with great and various advantages.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A sound making movable toy which is provided with a sound making device and driving wheels driven by a driving power source, said sound making device comprising: a blowing chamber being provided with a sounding aperture and a fan driven by said driving power source; a main resonance chamber adjoining said blowing chamber and communicating with said sounding aperture; a tubular resonance control chamber one side end of which communicates with said main resonance chamber and the other end of which is opened; a piston reciprocating within said resonance control chamber with sealed engagement; and a crank mechanism consisting of a movable crank rod and a rotating crank piece, one end of said rotating crank piece being connected to an end portion of a rotary shaft which is rotated by said driving power source by way of a series of gears and the other end of said rotating crank piece being pivoted to one end of said movable crank rod, and the other end of said movable crank rod being pivoted to the center of the outer surface of said piston; thereby various pitch sounds being produced by changing the resonant volume of a resonance space with the reciprocation of said piston.

2. A sound making movable toy as claimed in claim 1 wherein said resonance control chamber is of cross-sectionally oval or round cylinder.

3. A sound making movable toy which is provided with a sound making device and driving wheels driven by a driving power dource, said sound making device comprising: a blowing chamber being provided with a sounding aperture and a fan driven by said driving power source; a main resonance chamber adjoining said blowing chamber and communicating with said sounding aperture; a tubular resonance control chamber one side end of which communicates with said main resonance chamber and the other end of which is opened; a piston reciprocating within said resonance control chamber with sealed engagement; and a crank mechanism consisting of a movable crank rod and a rotating crank piece, one end of said rotating crank piece being connected to an end portion of a rotary shaft which is rotated by said driving power source by way of a series of gears and the other end of said rotating crank piece pivoted to one end of said movable crank rod, and the other end of said movable crank rod being pivoted to the center of the outer surface of said piston; and being characterized in that the maximum resonant volume of said resonance control chamber is double or more as compared with the resonant volume of said main resonance chamber and the length ratio of said rotating crank piece to said movable crank rod is in the range of 1:2 to 1:3, thereby producing the sounds covering almost one octave range by changing the volume of the resonance space with the movement of said piston.

* * * * *